US005890652A

United States Patent [19]

Taylor

[11] Patent Number: 5,890,652

[45] Date of Patent: Apr. 6, 1999

[54] SELF-REGULATING SNOWMAKING NOZZLE, SYSTEM AND METHOD

[76] Inventor: Peter Taylor, 471 Snydertown Rd., Craryville, N.Y. 12521

[21] Appl. No.: 889,466

[22] Filed: Jul. 8, 1997

[51] Int. Cl.[6] ..... F25C 3/04

[52] U.S. Cl. ..... 239/2.2; 239/14.2; 239/397.5; 137/79; 236/102

[58] Field of Search ..... 239/2.2, 8, 14.2, 239/397.5; 137/79, 80; 236/102

[56] References Cited

U.S. PATENT DOCUMENTS

| | | | |
|---|---|---|---|
| 4,353,504 | 10/1982 | Girardin et al. . | |
| 4,511,083 | 4/1985 | Muller-Girard . | |
| 4,634,050 | 1/1987 | Shippee . | |
| 4,730,774 | 3/1988 | Shippee . | |
| 4,828,175 | 5/1989 | Heufler et al. . | |
| 4,852,601 | 8/1989 | Chamberlin | 137/79 X |
| 4,883,082 | 11/1989 | Pirkle | 137/79 X |
| 4,891,935 | 1/1990 | McLaurin et al. | 239/397.5 |
| 5,135,167 | 8/1992 | Ringer . | |
| 5,180,105 | 1/1993 | Teague . | |
| 5,180,106 | 1/1993 | Handfield . | |
| 5,322,218 | 6/1994 | Melbourne . | |
| 5,529,242 | 6/1996 | Hedin . | |

*Primary Examiner*—Andres Kashnikow
*Assistant Examiner*—Robin O. Evans
*Attorney, Agent, or Firm*—Schmeiser, Olsen & Watts

[57] ABSTRACT

The present invention is a thermally self-regulating nozzle for a snowmaking machine. The invention also relates to a system including the nozzle and method of snowmaking using the nozzle. The nozzle includes an outer housing made of a first material and a thermally separated inner housing, and a nozzle assembly attached to the outer housing by a member made of a second material having a thermal coefficient of expansion lower than the first material. The size of the nozzle outlet being dependent upon the expansion/contraction of the outer housing to accommodate more efficient snowmaking over a range of temperatures.

21 Claims, 3 Drawing Sheets

SELF-REGULATING SNOWMAKING NOZZLE, SYSTEM AND METHOD

BACKGROUND OF THE INVENTION

1. Technical Field

The present invention relates generally to snowmaking machines. More particularly, the present invention relates to a thermally self-regulating nozzle for a snowmaking machine that allows snowmaking more efficiently over a variety of temperatures. The invention also relates to a system including the above nozzle and method of snowmaking using the above nozzle.

2. Related Art

Heretofore, ski areas and snow parks have used a variety of snowmaking machines to produce snow where annual snowfall is insufficient to assure a sufficiently long operating season. Each machine, called guns, have disadvantages which the present invention aims to address.

One type of snowmaker is the air and water gun. While these guns are relatively light, cheap to manufacture, and, in the case of a portable model, easy to setup, they are very expensive to operate. The cause of their high operational expense is that in order to provide the required amount of air for one gun, e.g., 200–500 cubic feet per minute (cfm), they require upwards of 75 horsepower (hp) to run. Accordingly, the power consumption required to operate one of these guns is exorbitant. In an effort to reduce the required air consumption (e.g., to 50 cfm using 12.5 hp), users have raised the height of the guns. However, raising the height of the gun has required the users to permanently mount the guns in an area, thus reducing their overall versatility. Furthermore, permanent mounting places the user at the mercy of favorable wind direction to achieve the desirable spread of snow on the ground.

Another type of snowmaker are portable fan guns. These guns, while producing large quantities of snow, are very large and heavy. As a result of their weight, permanent mounting of them is usually provided. Otherwise, a snowcat is required to move them. Therefore, the versatility of these guns, e.g., use on steep or rugged terrain, is severely limited. Further, top of the line versions oftentimes include onboard computers that control water flow rate relative to air temperature, thus increasing their costs.

The main disadvantage of the fan type snowmaker system is its initial cost. For instance, enough guns to cover one slope, e.g., 20 guns, will cost close to half a million U.S. dollars. Further, if the user wants to move the guns, a snowcat and larger numbers of workers are required.

An overall disadvantage of the above related devices, is their inability to accommodate efficient snowmaking for a variety of different temperatures without expensive microprocessor controlled systems.

Accordingly, it is the aim of the present invention to provide an inexpensive, versatile and highly efficient snowmaking machine which cures the above deficiencies in the related art.

SUMMARY OF THE INVENTION

In accordance with the present invention, a self-regulating nozzle which is adapted to be used in a snowmaking machine, or system of snowmaking machines, is provided. The resulting snowmaking machine according to the present invention is light weight such that it can be easily maneuvered around an area upon which snow is desired, inexpensive, and highly efficient.

In order to accomplish the above advantages, the present invention provides a self-regulating nozzle for use on a snowmaking machine which includes an inner housing and a thermally separated outer housing made of a material having a high coefficient of thermal expansion (CTE). To assure proper water droplet size at a variety of temperatures, the nozzle includes a nozzle assembly positioned within a chamber of the inner housing such that it creates a nozzle outlet between the inner housing and itself. However, the nozzle assembly is connected to the outer housing by a member being made of a material having a CTE lower than that of the outer housing so that changes in temperature that cause the outer housing to expand or contract also move the nozzle assembly and, hence, change the size of the nozzle outlet. Accordingly, with a proper initial setting, the size of the nozzle outlet is automatically adjusted by the thermal expansion/contraction of the outer housing so that water droplets are properly sized to be frozen into snow at a variety of temperatures.

The present invention is also a snowmaking system including a plurality of snowmaking machines including the above nozzle and a method of making snow incorporating the above nozzle.

With use of the present invention, a snowmaker acquires a light weight, easily movable snowmaking machine that can be positioned practically anywhere. The resulting snowmaking machine is also inexpensive to initially setup because it does not require a computer to accommodate snowmaking at varied temperatures. Further, it does not require non-stop attention for manual adjustment. The device also produces snow with less power consumption, i.e. 8 hp.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

While the nozzle in accordance with the present invention is disclosed for use in a snowmaking environment, it should be understood that the present invention may be utilized in a variety of other settings. For instance, it is contemplated that the present invention may find applicability where the need to create fine ice particles or coat a surface with ice is required.

Figure 1:
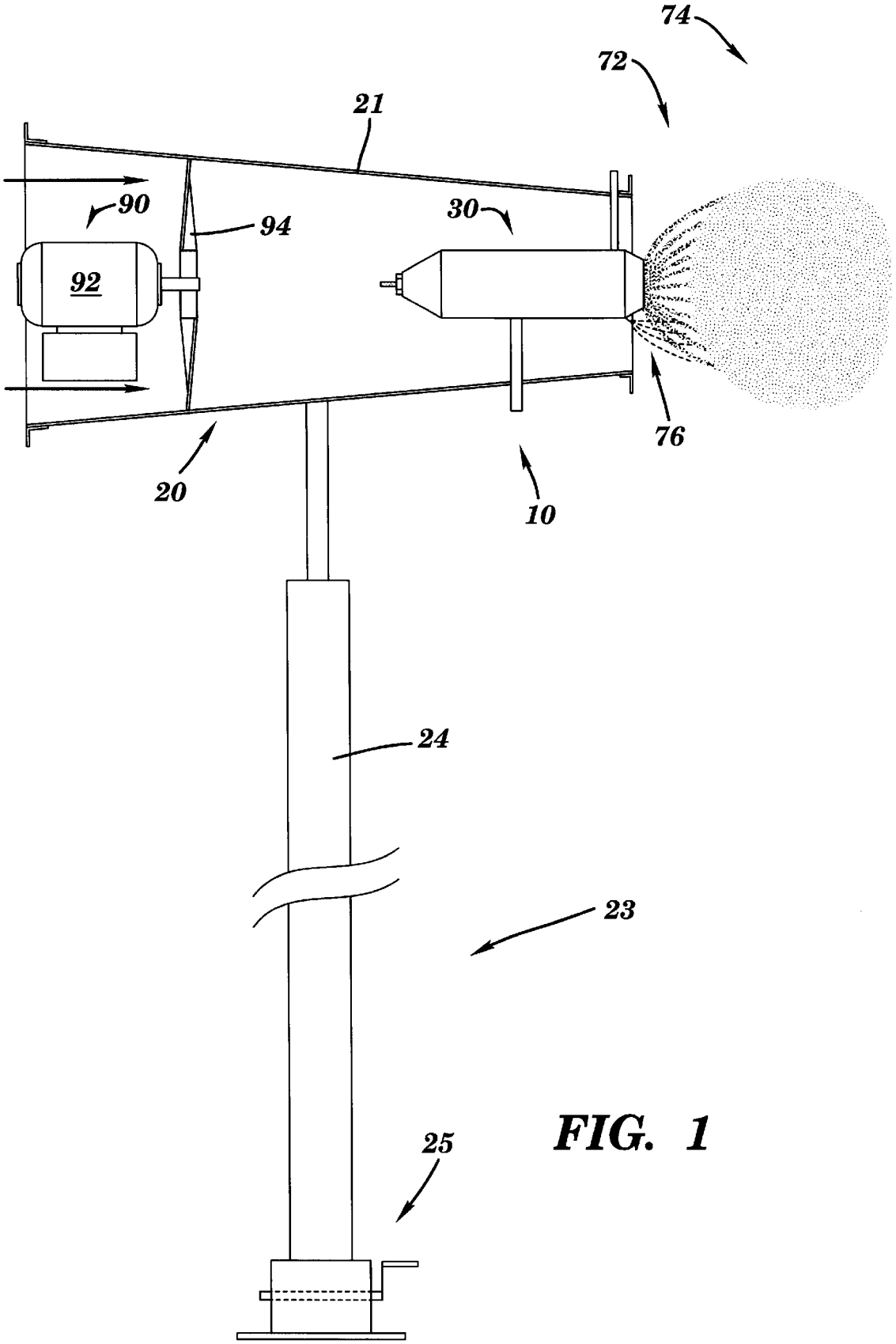
FIG. 1 shows a snowmaking machine using a nozzle in accordance with the present invention.

Turning to the drawings, FIG. 1 shows a snowmaking machine or gun 10 including a nozzle 30 in accordance with the present invention. The snowmaking machine generally includes a shroud 20 made of a steel frustoconical tube 21. The shroud may also be made of any other rigid material sufficient to withstand cold climates and support the internal components. The frustoconical shape of the shroud 21 allows for sufficient intake of air, compression of the air stream over the nozzle, and increase throw of the snow created.

For support, the snowmaking machine 10 may be supported on a stanchion 23. The stanchion includes a post 24 which is height and angularly adjustable by transmission 25. The stanchion 23 may be ground supported or mounted on a wheeled vehicle or cart (not shown) for transport to a variety of positions. The angular and height adjustability aids in directing snow to needed areas, accommodating varying wind directions, and efficiently producing snow.

The shroud 21 houses the essential components of the snowmaking machine, namely the fan 90 and nozzle 30. The fan is mounted in a rear portion of the shroud and includes a motor 92 and a plurality of fan blades 94. The fan forces an air stream into the shroud 21, over the nozzle 30 and out the opposite end of the shroud 21 to freeze the output of the nozzle into snow. The strength of the fan motor 92 is also sufficient to spread the snow out over a surface to be covered and is preferrably about an 8 horsepower (hp) motor. The nozzle 30 is mounted in a front portion of the shroud 21 and is supported by a compressed air supply pipe 43 and pressurized water supply pipe 38, referenced in FIG. 2.

Figure 2:
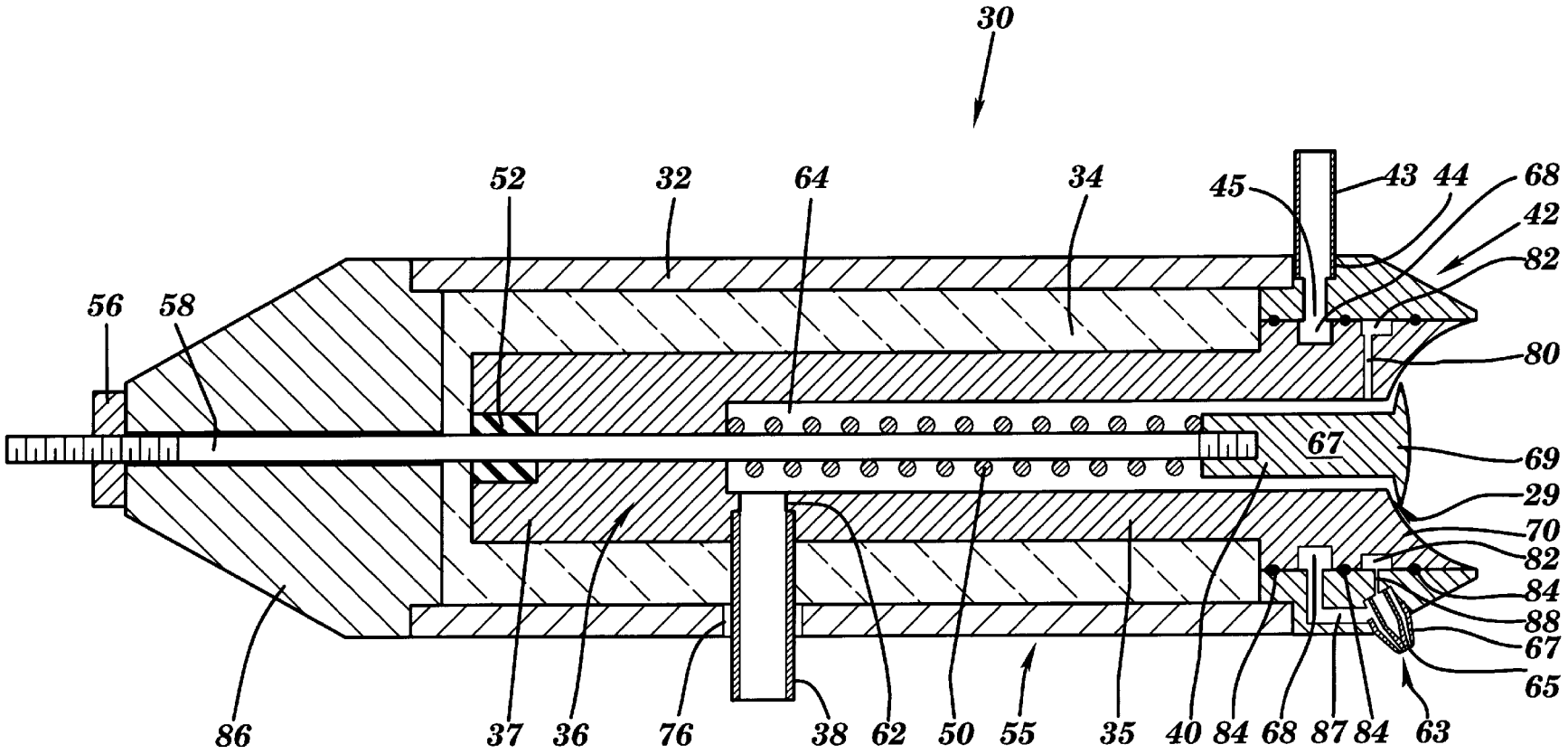
FIG. 2 shows a cross-sectional view of the nozzle in accordance with the present invention.

FIG. 2 shows a cross-sectional view of the nozzle 30 in accordance with the present invention. The nozzle generally includes an outer housing or member 32 that encircles a thermal insulator 34 that, in turn, encircles an inner housing or member 36. The thermal insulator 34 acts to thermally separate the outer housing 32, exposed to ambient temperatures, from the inner housing 36.

The inner housing 36 includes a longitudinally extending internal chamber 64 which exits a front end 35 of the inner housing. The inner chamber 64 recieves pressurized water through an inlet port 62. The pressurized water is delivered to the nozzle by a water supply pipe 38 which connects to inlet port 62 of the inner housing 36 and extends radially outward through the insulator 34 and opening 76 of outer member 32. The inner housing 36 is preferably made out of stainless steel. The water is usually in the range of 40° to 50° F.

A nozzle assembly 40 of the nozzle 30 includes a rear portion 67 which extends into the chamber 64 and a generally disk-shaped end 69 which is positioned adjacent an outer portion of the inner housing 32 to form a nozzle outlet 29. The position of the nozzle assembly 40 is determined by a stem or member 58 which is threadably attached to the rear end 67 of the nozzle assembly 40. The stem 58 extends through a bore in the rear end 37 of the inner housing, the insulator 34 and a frustoconical member 86 of the outer housing 32 at the rear of the nozzle. A seal 52 is provided at the rear end 37 of the inner housing 36 to prevent water leakage from the chamber 64 to the insulator 34.

The stem 58 also extends through a spring 50 inside the chamber 64. The spring 50 is compressed against the inside rear end of chamber 64 and the rear portion 67 of the nozzle assembly 40. The spring 50 thus forces the nozzle assembly to a forwardmost position relative to the inner housing 36.

The position of stem 58 and, hence, nozzle assembly 40 is initially set by a nut 56 threaded onto an external end of the stem 58. Tightening of the nut 56 on the stem 58 compresses the spring 50 to initially adjust the position of the nozzle assembly 40 and hence the size of the nozzle output 29. The stem is preferably made out of stainless steel or tungsten for their low coefficient of thermal expansion.

The outer member 32 is preferrably made out of either aluminum or a magnesium alloy for their high coefficient of thermal expansion. However, the outer member 32 may be made of any material which has a higher coefficient of thermal expansion than that of the stem 58. The frustoconical member 86 is made out of the same material as the outer housing.

At the front end of the nozzle, at least one nucleator 63 is provided to create tiny water droplets or nuclei 76, shown in FIG. 1. Preferrably, three nucleators are provided, however, any number sufficient to "seed" the water droplets 72 formed by the nozzle outlet can be used. The nucleators 63 are mounted to the nozzle via a nucleator flange 42, as shown in FIG. 2.

The nucleator flange 42 is preferrably mounted on the outer, front end 35 of the inner housing 36. The inner housing 36, on an outer circumference thereof, includes a pressurized water manifold 82 and a compressed air manifold 68. Each manifold is formed as a groove that encircles the periphery of the inner housing. The nucleator flange and inner housing are pneumatically and fluidly sealed to one another by seals 84. However, it is contemplated that the seals 84 may be replaced by a snap fit (not shown) which provides a self-sealing connection of the nucleator flange 42 to the inner housing 36.

Compressed air is supplied to the nozzle via a compressed air supply pipe 43 which is mounted to the nucleator flange 42 at air inlet 44. The nucleator flange 42 includes a passage 45 to allow air flow to manifold 68 in the inner housing 36. Furthermore, pressurized water is supplied to the nucleator flange 42 from the water manifold 82 via a passage 80 that extends from the water manifold 82 to the chamber 64.

The nucleator flange 42 also includes a passage 87 from each nucleator 63 to the air manifold 68 and a passage 88 from each nucleator to the water manifold 82. Each nucleator 63 generally includes a water nozzle 65 concentrically located within an air nozzle 67. It should be noted, however, that any nozzle system which can mix air and water to form nuclei or tiny water droplets 72 may alternatively be used. Each water nozzle 65 receives pressurized water from passage 88 and each air nozzle 67 receives compressed air from passage 87. As the compressed air and water are ejected from the respective nucleator, tiny water droplets or nuclei 76, shown in FIG. 1, are created.

In operation, the snowmaking machine incorporating the present invention is either permanently mounted, or placed via a wheeled cart, adjacent an area to be covered by snow. Pressurized water, usually in the range 40° to 50° F. is supplied to the snowmaking machine via supply pipe 38 and compressed air is supplied via pipe 43. Ambient air, below or at 32° F., is forced through the shroud 21 via fan 90 and passes over the nozzle 30 as it is compressed. The compressed air and pressurized water are mixed to form nuclei or tiny water droplets 76 in the air stream near the front of the shroud 21. As the air stream meets the nuclei, the nuclei are frozen into tiny crystals. The tiny crystals are then carried by the air stream into the water droplets 72 exiting the nozzle outlet 29. The tiny crystals "seed", or in other words combine with, the water droplets 72 to form snow crystals 74. The snow crystals are then thrown by the residual force of the air stream out over the area to be covered with snow.

In order to efficiently create snow at an initial temperature, the nozzle may require initial adjustment of the size of the nozzle outlet 29 so that proper sized water droplets are created for the corresponding temperature. However, unlike the related art discussed herein, the present invention is self-regulating and requires little if any further modification for changes in temperature. This self-regulation is provided by the materials of the nozzle having different coefficients of thermal expansion and being subjected to different temperatures.

As a general rule, low temperatures allow for larger snow crystal production and thus require larger water droplet size. On the other hand, higher temperatures, require smaller water droplet size. As can be surmised from the explanation above, the determination of the water droplet size is determined by the size of the nozzle outlet 29.

During a temperature change, the inner housing 36, made of stainless steel, is not subjected to ambient temperatures along its entire length and is substantially insulated from heat conduction by insulator 34. Accordingly, the inner housing 36 is at the temperature of the water being injected therein, e.g., between 40° and 50° F. However, the outer housing 32 and frustoconical member 86, made preferrably of aluminum, are subject to the ambient temperature change. Further, the stem 58 is made out of a material, e.g., stainless steel, having a CTE lower than that of the outer housing. As a result, for instance, during a drop in temperature, the aluminum of the outer housing 32, having a large coefficient of thermal expansion, contracts. The inner housing 36 remains at water temperature because of the insulator 34 and, accordingly, experiences little if any contraction/expansion. Further, the stem 58 experiences less contraction than that of the outer housing 32. As a result, the stem 58 via spring 50 moves the nozzle assembly 40 and hence disk-shaped member 69 farther away from the inner housing 36 thus increasing the size of the nozzle outlet 29. The larger nozzle outlet then creates water droplets of a larger size which allows creation of larger snow crystals at the lower temperatures.

Similarly, a rise in temperature causes an expansion in the aluminum, thus creating a smaller nozzle outlet and smaller water droplets 72.

Figure 3:
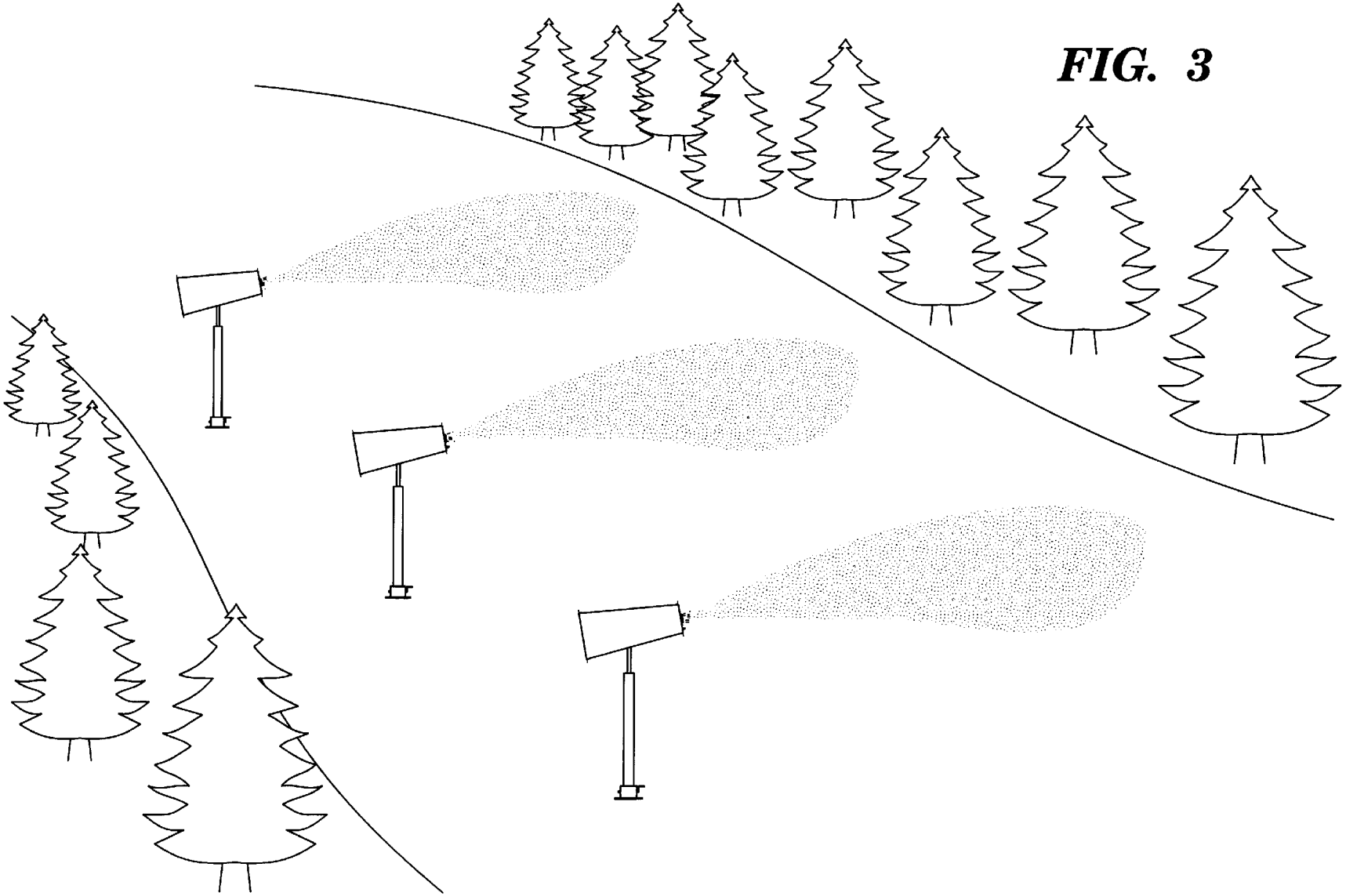
FIG. 3 shows a snowmaking system including a plurality of snowmaking machines incorporating the nozzle in accordance with the present invention.

As shown in FIG. 3, a further aspect of the present invention is its use in a snowmaking system incorporating one or more snowmaking machines 10. The use of more than one snowmaking machine increases the overall efficiency of a snowmaking operation, i.e. a ski area, and can greatly reduce power consumption and required manpower.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

For instance, while the essential components of the nozzle in accordance with the present invention have been disclosed as being manufactured of particular materials for their given coefficients of thermal expansion, one with ordinary skill in the art should recognize that other materials are also possible. The key aspect being that the member which controls the size of the nozzle outlet be made of a material having a coefficient of thermal expansion greater than that of the other members so that the nozzle outlet size decreases for rises in temperature and increases for decreases in temperature.

I claim:

1. A self-regulating nozzle adapted for use on a snowmaking machine, the nozzle comprising:

an outer housing made of a first material;

an inner housing;

a nozzle assembly operatively positioned to form a nozzle outlet relative to the inner housing;

a member connecting the outer housing and nozzle assembly, the member made of a second material having a coefficient of thermal expansion lower than that of the first material, whereby the size of the nozzle outlet is automatically adjusted by the thermal expansion/contraction of the first material in response to a change in ambient temperature.

2. The nozzle of claim 1, further including:

an inner chamber in the inner housing in which the nozzle assembly is operatively positioned;

an insulator thermally separating the inner housing and outer housing; and a pressurized water passage to supply pressurized water to the chamber.

3. The nozzle of claim 2, further including a nucleator flange mounted adjacent the nozzle outlet, the nucleator flange including a compressed gas inlet, a high pressure water inlet and at least one nucleator that combines the high pressure water and gas to form tiny water particles.

4. The nozzle of claim 3, wherein the inner housing includes a circumferential gas manifold in fluid communication with the compressed gas inlet, and the nucleator flange includes a passage in fluid communication with the gas manifold and each of the at least one nucleator.

5. The nozzle of claim 3, wherein the inner housing includes a circumferential water manifold in fluid communication with the inner chamber, and the nucleator flange includes a passage from each at least one nucleator to the water manifold.

6. The nozzle of claim 3, wherein the compressed gas is air.

7. The nozzle of claim 1, wherein the first material is one of: aluminum and magnesium alloy; and the second material is one of stainless steel and tungsten.

8. The nozzle of claim 1, wherein the member is an adjustably positioned, spring biased stem that extends through the inner housing, insulator and outer housing.

9. The nozzle of claim 8, wherein the outer housing includes a frustoconical member connected on a rear end of the nozzle, the stem extending through the frustoconical member and being adjustably positioned against an end of the frustoconical member by a nut threaded on an end of the stem.

10. The nozzle of claim 1, wherein the nozzle assembly is made of stainless steel.

11. A snowmaking system including at least one snowmaking machine, each snowmaking machine comprising:

a nozzle including:

a first member made of a first material;

a second member made of a second material having a lower coefficient of thermal expansion than that of the first material;

a third member;

a nozzle assembly operatively connected to the first member by the second member, the nozzle assembly forming a nozzle outlet between the nozzle assembly and the third member;

a pressurized water passage to supply pressurized water to the nozzle outlet to form water droplets upon exit therefrom; and a fan shroud surrounding the nozzle having a fan to supply a stream of cold air over the nozzle to eject the water droplets from an end of the shroud.

12. The snowmaking system of claim 11, further including a nucleator flange mounted adjacent the nozzle outlet, the nucleator flange including a compressed gas inlet, a high pressure water inlet and at least one nucleator that combines the high pressure water and gas to form tiny water particles.

13. The snowmaking system of claim 12, wherein the third member includes a circumferential gas manifold in fluid communication with the compressed gas inlet, and the nucleator flange includes a passage in fluid communication with the gas manifold and each of the at least one nucleator.

14. The snowmaking system of claim 12, wherein the third member includes a circumferential water manifold in fluid communication with the pressurized water passage, and the nucleator flange includes a passage from each at least one nucleator to the water manifold.

15. The snowmaking system of claim 11, wherein the nozzle further includes an insulator thermally separating the first member and the third member.

16. The snowmaking system of claim 11, wherein the first material is one of aluminum and magnesium alloy, and the second material is one of stainless steel and tungsten.

17. The snowmaking system of claim 16, wherein the nozzle assembly and third member are made of stainless steel.

18. The snowmaking system of claim 11, wherein the second member is a spring biased stem.

19. The snowmaking system of claim 18, wherein the first member includes a frustoconical member connected on a rear end of the nozzle and the stem is adjustably connected against the frustoconical member.

20. A method of making snow comprising the steps of:

providing a thermally self-regulating nozzle including a first member made of a first material, a second member made of a second material having a lower coefficient of thermal expansion than that of the first material, and a nozzle assembly connected to the first member by the second member;

spraying pressurized water through the nozzle assembly to form water droplets having a size determined by an expansion/contraction of the first member;

nucleating pressurized water with compressed air to form tiny water nuclei adjacent an end of the nozzle; and freezing the tiny water nuclei within the spray of pressurized water droplets and the water droplets to form snow.

21. The method of making snow of claim 20, further including the step of blowing cold air over the nozzle to freeze the tiny water nuclei within the spray of pressurized water droplets.

* * * * *